US006000725A

United States Patent [19]

Nicolosi et al.

[11] Patent Number: 6,000,725

[45] Date of Patent: Dec. 14, 1999

[54] LOTTERY TICKET AND METHOD OF PLAYING A LOTTERY GAME

[75] Inventors: Roy S. Nicolosi, East Greenwich, R.I.; Steven Schottenfeld, Canton, Mass.

[73] Assignee: GTECH Rhode Island Corporation, W. Greenwich, R.I.

[21] Appl. No.: 09/066,521

[22] Filed: Apr. 24, 1998

[51] Int. Cl.[6] ..... A63F 1/02

[52] U.S. Cl. ..... 283/67; 235/66; 235/68; 235/73; 235/74; 235/87 R; 235/487; 283/65; 283/903; 463/17

[58] Field of Search ..... 235/66, 68, 73, 235/74, 87 R, 487; 283/65, 67, 903; 463/17

[56] References Cited

U.S. PATENT DOCUMENTS

| | | | |
|---|---|---|---|
| 1,304,773 | 5/1919 | Howell . | |
| 1,833,869 | 11/1931 | Cotton et al. . | |
| 3,487,573 | 1/1970 | Slovacek | 40/124.1 |
| 3,512,780 | 5/1970 | Allison | 273/139 |
| 4,099,721 | 7/1978 | Logander | 273/139 |
| 4,551,373 | 11/1985 | Conlon | 428/43 |
| 4,775,154 | 10/1988 | Clinnin et al. | 273/138 R |
| 4,781,378 | 11/1988 | Clinnin et al. | 273/138 R |
| 5,076,613 | 12/1991 | Kovacs | 283/106 |

FOREIGN PATENT DOCUMENTS 404019195 1/1992 Japan .

*Primary Examiner*—Willmon Fridie, Jr.
*Assistant Examiner*—Mark T. Henderson
*Attorney, Agent, or Firm*—Fish & Richardson P.C.

[57] ABSTRACT

A lottery ticket includes an upper edge, a lower edge, opposite side edges, and a first area located adjacent the upper edge, the first area having a first set of gaming indicia disposed thereon that form lower portions of prize symbols. A second area is located adjacent the lower edge, the second area having a second set of gaming indicia disposed thereon that form upper portions of prize symbols. The arrangement is such that upon folding the ticket about a horizontal axis and aligning the second set of gaming indicia above the first set of gaming indicia, the winning status of the lottery ticket is determined if the upper portions of prize symbols register with the lower portions of prize symbols to create at least one complete prize symbol. Other lottery ticket constructions are further contemplated. A method of playing a lottery game is further disclosed.

10 Claims, 6 Drawing Sheets

LOTTERY TICKET AND METHOD OF PLAYING A LOTTERY GAME

BACKGROUND OF THE INVENTION

This invention relates generally to lottery tickets and methods of playing a lottery game, and more particularly to a new type of lottery ticket that allows players of lottery paper-based games to determine whether the lottery ticket is a winning ticket by decrypting information contained on the ticket which is achieved by manipulating the ticket a certain way.

Players of paper-based games of chance can usually determine whether they have won by either waiting for the results of a drawing (e.g., as with a typical "numbers"-type lottery ticket) or by examining the ticket for information (e.g., as with an instant ticket). Instant tickets that require the player to scratch off an opaque layer (e.g., "scratch"-type instant tickets) are also well known in the art.

There is presently a need for another paper-based game that enables a player to decrypt information on the ticket so as to add to the suspense of whether the player owns a winning ticket. Scratch-type tickets, although suitable for their intended purpose, are somewhat expensive to manufacture primarily due to their heavy stock substrate and to the process of applying the opaque layer. Specifically, there is a need for an on-line lottery ticket that requires the player to manipulate the ticket (as with a scratch-type ticket) to determine whether the ticket is a winner. Presently, on-line tickets are used primarily for numbers-type games, and the like. Such games are not particularly exciting since the player must wait for a drawing to occur, unlike an instant ticket where the status of a winning ticket is immediately, or nearly immediately, identified.

SUMMARY OF THE INVENTION

Among the several objects of the present invention are: the provision of a new lottery ticket and method of playing a lottery game in which the winning status of the ticket cannot be ascertained by simply viewing the face of the ticket, but requires a player to decrypt information on the ticket thereby adding to the suspense of whether the player won; and the provision of such a lottery ticket and method of playing a lottery game which is simple to play by easily manipulating the lottery ticket.

In general, a lottery ticket comprises an upper edge, a lower edge, opposite side edges, and a first area located adjacent the upper edge, the first area having a first set of gaming indicia disposed thereon that form lower portions of prize symbols. A second area is located adjacent the lower edge, the second area having a second set of gaming indicia disposed thereon that form upper portions of prize symbols. The arrangement is such that upon folding the ticket about a horizontal axis and aligning the second set of gaming indicia above the first set of gaming indicia, the winning status of the lottery ticket is determined if the upper portions of prize symbols register with the lower portions of prize symbols to create at least one complete prize symbol.

In a second aspect of the invention, a method of playing a lottery game with a ticket comprises the steps of: (a) folding the ticket about the horizontal axis; and (b) aligning the second set of gaming indicia above the first set of gaming indicia. The lottery ticket is a winning ticket if the upper portions of prize symbols register with lower portions of prize symbols to create at least one complete prize symbol.

In a third aspect of the invention, a lottery ticket comprises a front surface, a first edge, and a first area on the front surface. The first area is located adjacent the first edge and has a first set of gaming indicia disposed thereon that form upper portions of prize symbols. A second area is also located on the front surface. The second area is parallel to the first area and spaced from the first area. The second area has a second set of gaming indicia disposed thereon that form lower portions of prize symbols. The arrangement is such that upon folding the ticket about a horizontal axis and aligning the second set of gaming indicia below the first set of gaming indicia, the winning status of the lottery ticket is determined if the upper portions of prize symbols register with the lower portions of prize symbols to create at least one complete prize symbol.

In a fourth aspect of the invention, a lottery ticket comprises a front surface, a back surface, and a first edge. A first area is located on the front surface adjacent the first edge, the first area having a first set of gaming indicia disposed thereon that form upper portions of prize symbols. A second area is also located on the back surface, the second area being parallel to the first area and having a second set of gaming indicia disposed thereon that form lower portions of prize symbols. The arrangement is such that upon folding the ticket about a horizontal axis and aligning the second set of gaming indicia below the first set of gaming indicia, the winning status of the lottery ticket is determined if the upper portions of prize symbols register with the lower portions of prize symbols to create at least one complete prize symbol.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENTS

Figure 1:
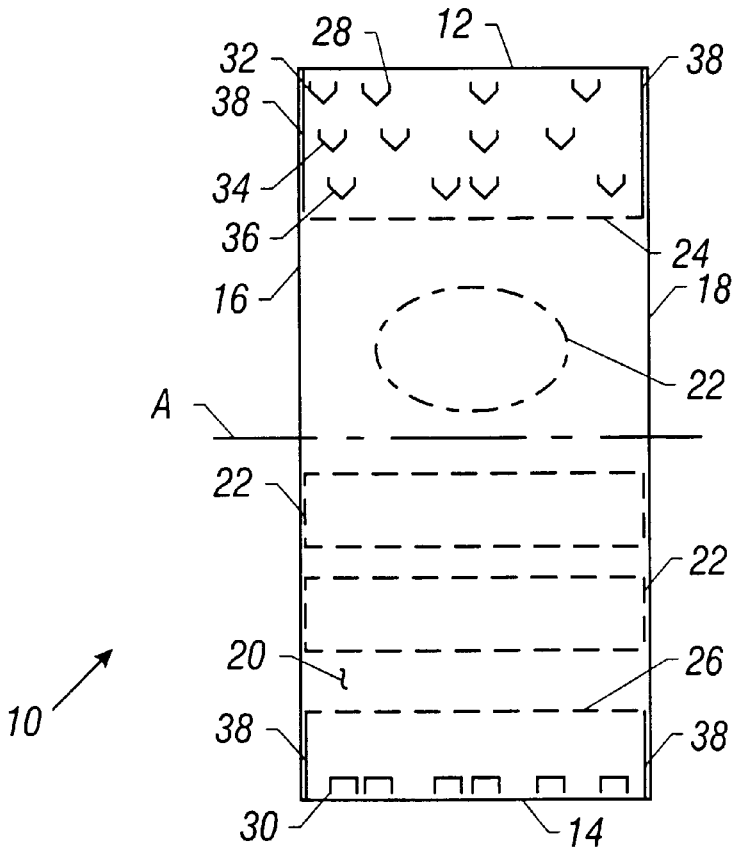
FIG. 1 is a front elevational view of a lottery ticket of the present invention.

Referring now to the drawings, and more particularly to FIGS. 1–4, there is generally indicated at 10 a lottery ticket of a first embodiment of the present invention. As shown, the lottery ticket 10 is fabricated from paper stock material that is relatively light in weight. Preferably, the lottery ticket 10 can be produced locally by a lottery terminal (not shown) that is in communication with a central processing station (also not shown). Such lottery terminals are well known in the art and require no further description. It should also be understood that the lottery ticket 10 can be fabricated from any material that is capable of receiving print thereon, and is resilient in nature so that the player can easily manipulate the lottery ticket in the manner to be described below.

As shown, the lottery ticket 10 has a rectangularly-shaped body with an upper edge 12, a lower edge 14, a left-hand edge 16 and a right-hand edge 18. The basic shape and size of the lottery ticket 10 is similar to that of a commonly available ticket. Of course, for the purposes of the present invention, it is insignificant that the lottery ticket 10 is longer in length than in width since the principles of this invention can be applied equally as well to tickets having varying shapes and sizes. An upper surface 20 of the lottery ticket 10 includes a plurality of areas, each indicated at 22, each area 22 having indicia, such as the name of the lottery game, bar code information, time and date information, etc. Such information is germane to most lottery tickets and is required for, among other things, validation purposes.

However, unlike prior lottery tickets, the upper surface 20 of lottery ticket 10 further includes a first area 24 that is located adjacent the upper edge 12 and a second area 26 that is located adjacent the lower edge 14. The first and second areas 24, 26 have first and second sets of gaming indicia 28, 30, respectively, disposed thereon in the conventional manner, i.e., by a printing process. Specifically, the first set of gaming indicia 28 represents the lower halves or portions of prize symbols which, as depicted in FIGS. 1–4, are the lower halves of home bases for a lottery game having a baseball theme. Similarly, the second set of gaming indicia 30 represents the upper halves or portions of prize symbols which are the upper halves of home bases. The type of game played with such indicia can be a matching game requiring at least three completed home bases in order for the ticket 10 to be a winning ticket. As shown, the first set of gaming indicia 28 includes three rows 32, 34 and 36 of lower half symbols, each row having five lower half portions of home base. The second set of gaming indicia 30 includes only one row of upper half symbols and six upper half portions of home base. It should be noted that the provision of one or more rows and one or more symbol portions is at the complete discretion of the lottery provider.

Figure 2:
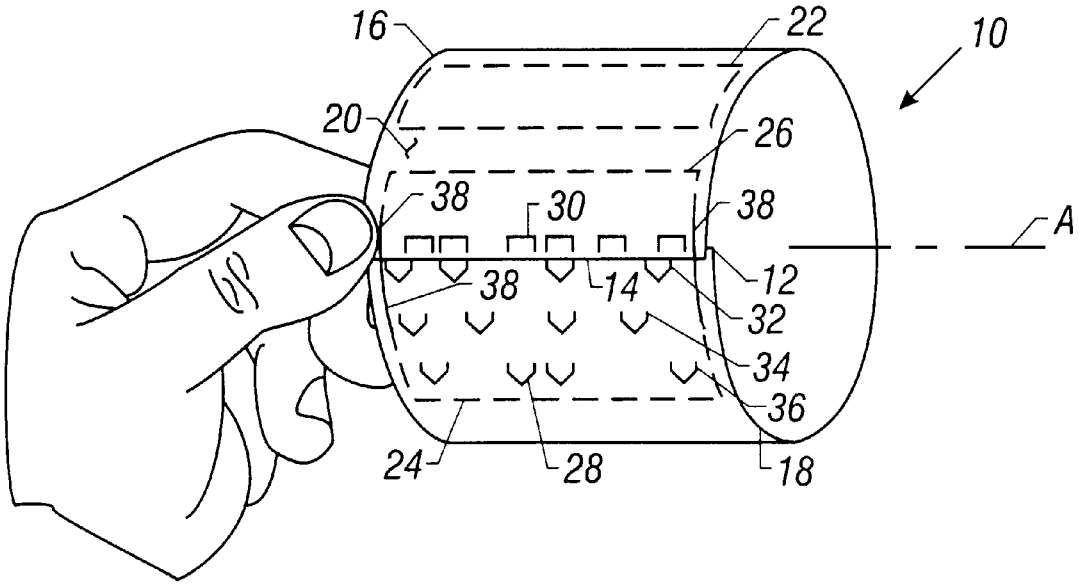
FIG. 2 is a front perspective view of the lottery ticket illustrated in FIG. 1 being manipulated for decryption by a player.
Figure 3:
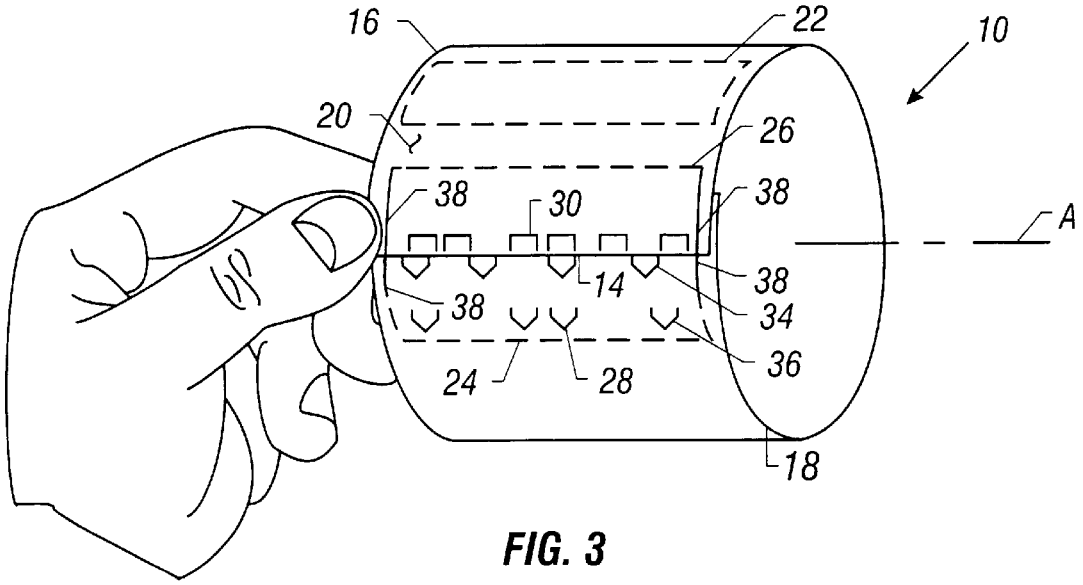
FIG. 3 is a front perspective view similar to FIG. 2.
Figure 4:
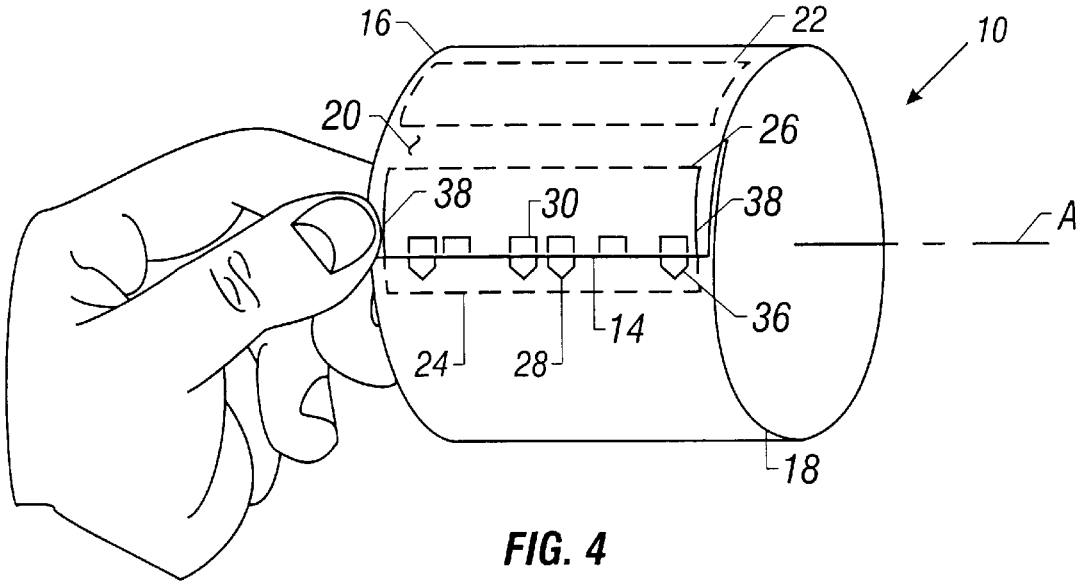
FIG. 4 is a front perspective view similar to FIGS. 2 and 3.

In order to facilitate the folding of the lottery ticket 10 in the manner shown in FIGS. 2–4, the upper surface 20 further includes two pairs of vertical alignment marks, each alignment mark being indicated at 38. As shown, one pair is located along side edge 16 and another pair is located along side edge 18. For each pair, one alignment mark 38 is positioned generally adjacent the upper edge 12 while the other alignment mark 38 is positioned adjacent the lower edge 14. Each pair of alignment marks are disposed a predetermined distance from their respective side edge 16 or 18. Upon folding or wrapping the lottery ticket 10 so that the alignment marks 38 register with one another, the second set of gaming indicia 30 can be aligned with the first set of gaming indicia 28 for determining the winning status of the lottery ticket 10.

The alignment marks 38 aid in eliminating fraud in that players may be tempted to cut and paste tickets together to make them appear as winners. Alignment marks 38 can mitigate against such an occurrence. As shown throughout the drawings, there are four alignment marks 38; however, it should be understood that any number of alignment marks or lines can be printed on the ticket 10 and still fall within the scope of the present invention. In addition, the alignment marks can be provided with varying widths.

Specifically, the arrangement is such that upon folding the ticket 10 about an imaginary horizontal axis A and aligning the second set of gaming indicia 30 over the first set of gaming indicia 28 (e.g., via the alignment marks 38), the winning status of the lottery ticket 10 is determined if a predetermined number of upper halves of prize symbols register with the lower halves of prize symbols to create one or more complete symbol (e.g., a home plate). For example, a game can require at least three registrations or matches of upper halves of prize symbols with lower halves of prize symbols in order for the ticket to be considered a "winning" ticket. Thus, in FIG. 2, when the second set of gaming indicia 30 is aligned over the first (top) row 32 of the first set of gaming indicia 28, only two home plates are created. In FIG. 3, when the second set of gaming indicia 30 is aligned over the second (middle) row 34 of the first set of gaming indicia 28, only one home plate is created. However, in FIG. 4, when the second set of gaming indicia 30 is aligned over the third (bottom) row 36 of the first set of gaming indicia 28, four home plates are created. Accordingly, the ticket 10 depicted in FIGS. 1–4 is a winning ticket by virtue it having at least three registrations of halves of prize symbols to create three home plates in the third row 36 as identified in FIG. 4.

Thus, it should be observed that the lottery ticket 10 of the instant invention provides a player with multiple opportunities to win on a single ticket, as with an instant ticket, but can be generated by a standard terminal since there are no special materials to be applied to the ticket. The player "plays" by aligning the first and second sets of gaming indicia 28, 30, and specifically by aligning the second set of gaming indicia 30 with a row (32, 34 or 36) of the first set of gaming indicia 28. This provides excitement to the game that makes it particularly attractive to players since the typical player cannot determine the winning status of the ticket by merely viewing the face of the ticket.

Figure 5:
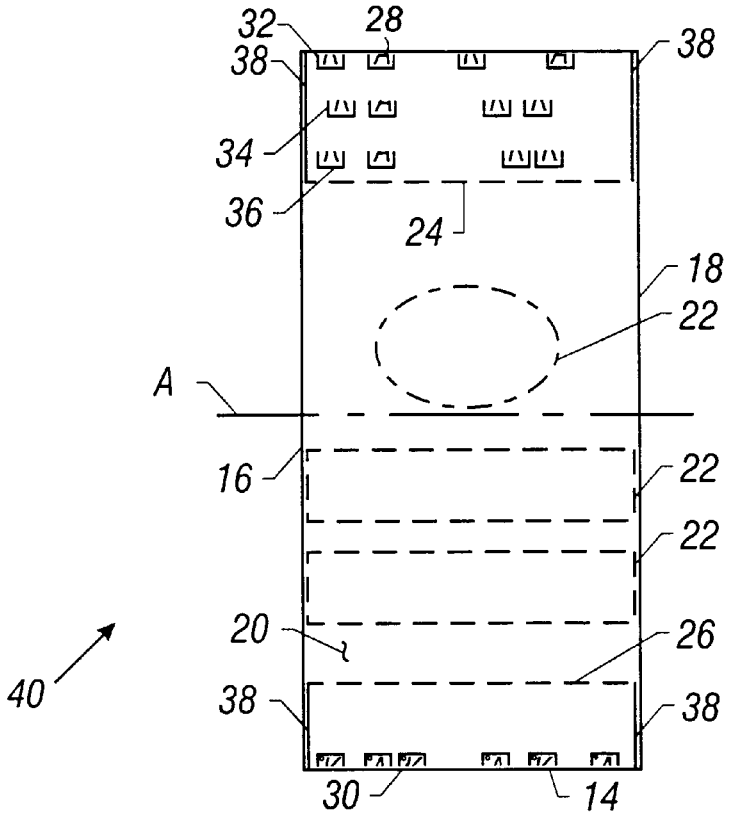
FIG. 5 is a front elevational view of a lottery ticket of a second preferred embodiment.
Figure 6:
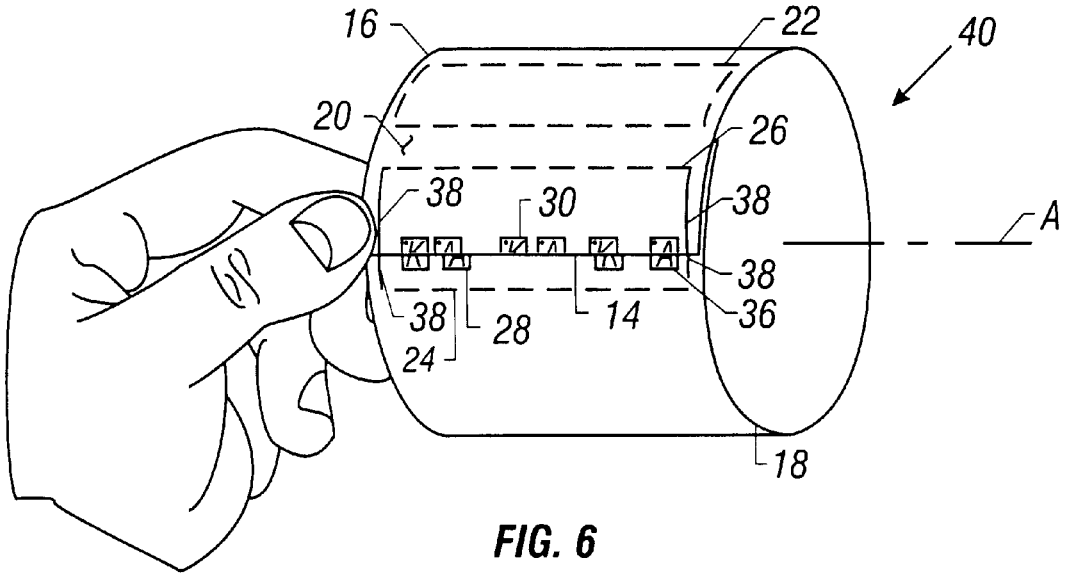
FIG. 6 is a front perspective view of the lottery ticket illustrated in FIG. 5 being manipulated for decryption by a player.

Turning now to FIGS. 5 and 6, there is generally indicated at 40 a lottery ticket of a second embodiment. Lottery ticket 40 is nearly identical to lottery ticket 10, except for the particular designs of the gaming indicia. Thus, the particular components of the lottery ticket 40 are designated with the same reference numbers used for lottery ticket 10. The particular game designated in lottery ticket 40 is based upon matching two or more playing card symbols. As shown in FIG. 5, the first set of gaming indicia 28 includes the lower portions of the playing card ace symbols "A" and the lower portions of the playing card king symbols "K". The second set of gaming indicia 30 includes the upper portions of the same playing card symbols. Referring to FIG. 6, the lottery ticket 40 is a winner when at least two upper portions are aligned and register with at least two lower portions to create complete symbols (e.g., the king "K" and the ace "A"). The specific details of determining the winning status of the lottery ticket 40 can be chosen by the lottery provider.

Figure 7:
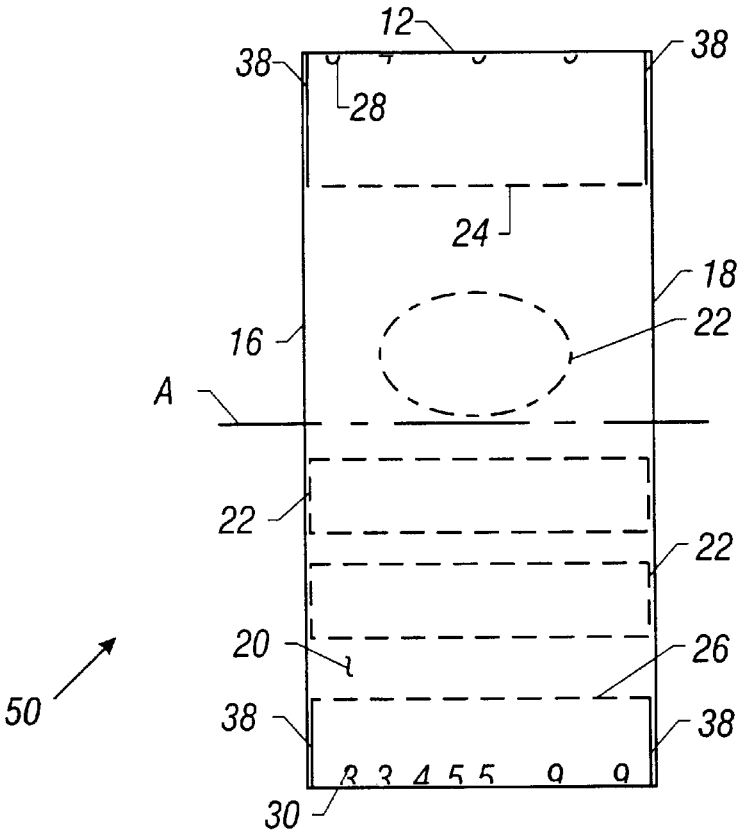
FIG. 7 is a front elevational view of a lottery ticket of a third preferred embodiment.
Figure 8:
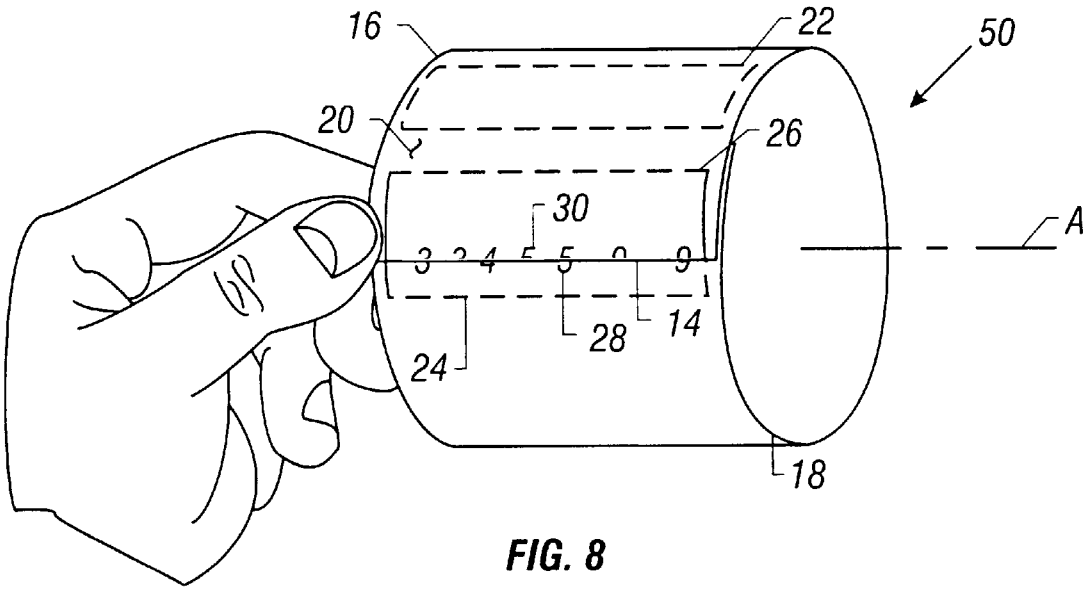
FIG. 8 is a front perspective view of the lottery ticket illustrated in FIG. 7 being manipulated for decryption by a player.

Referring to FIGS. 7 and 8, there is generally indicated at 50 a lottery ticket of a third embodiment. As shown, the gaming indicia of lottery ticket 50 includes upper and lower portions of numbers that must be aligned and register with one another to create complete numbers. By registering three such numbers, as shown in FIG. 8, the ticket is a winner. It should be understood that even though only one row of numbers is illustrated, more rows can be added as with lottery tickets 10 and 40 and still fall within the scope of the present invention.

With each of the foregoing embodiments of the lottery ticket, the general method of playing a lottery game is the same. Specifically, the tickets are folded in half about their respective horizontal axes, and the second sets of gaming indicia is aligned over the first sets of gaming indicia. Each lottery ticket is a winner if the upper half of prize symbols register with lower half of prize symbols to create at least one complete prize symbol. If more than one row is provided with either the first or second set of gaming indicia, the player aligns the respective set with each row.

Figure 9:
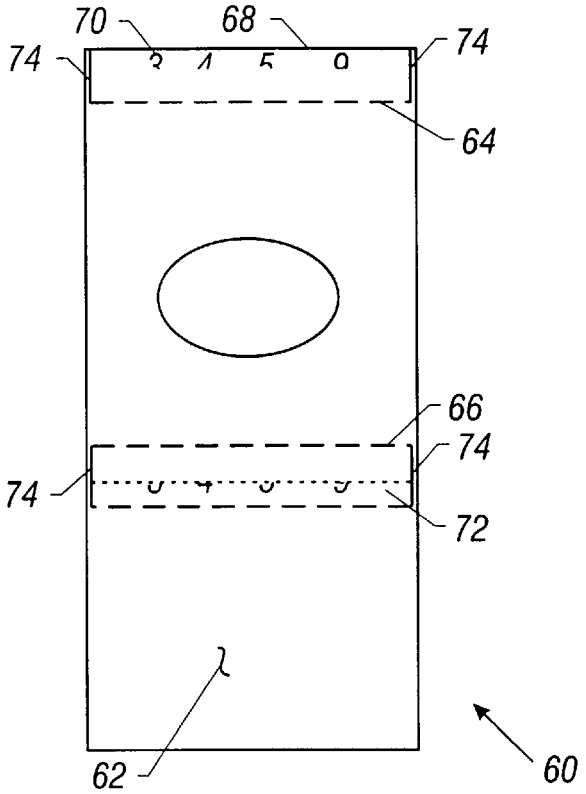
FIG. 9 is a front elevational view of a lottery ticket of a fourth preferred embodiment.
Figure 10:
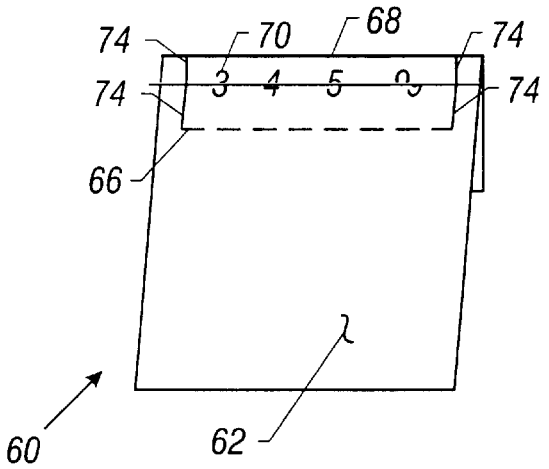
FIG. 10 is a front perspective view of the lottery ticket illustrated in FIG. 9 being manipulated for decryption.

Turning to FIGS. 9 and 10, there is generally indicated at 60 a lottery ticket of a fourth embodiment. As shown, the lottery ticket 60 has a front surface 62 on which first and second areas 64, 66 are provided. The first area 64 is located adjacent the top edge 68 and has a first set of gaming indicia 70 disposed thereon that form upper halves or portions of prize symbols. The second area 66 is generally parallel to the first area 64, and is spaced from the first area 64 a predetermined distance. The second area 66 has a second set of gaming indicia 72 disposed thereon that form lower halves or portions of prize symbols.

FIG. 10 illustrates the decryption of the lottery ticket 60 by folding the ticket in such a manner that the second set of gaming indicia 72 are aligned below the first set of gaming indicia 70. The winning status of the lottery ticket is determined if the upper portions of prize symbols of the first set of gaming indicia 70 register with the lower portions of prize symbols of the second set of gaming indicia 72 to create at least one complete prize symbol. With the lottery ticket 60 illustrated in FIG. 10, three out of four of the upper and lower prize symbols register with one another to create three legible and readable numbers. Alignment marks 74 are further provided for the reasons set forth above.

Figure 11:
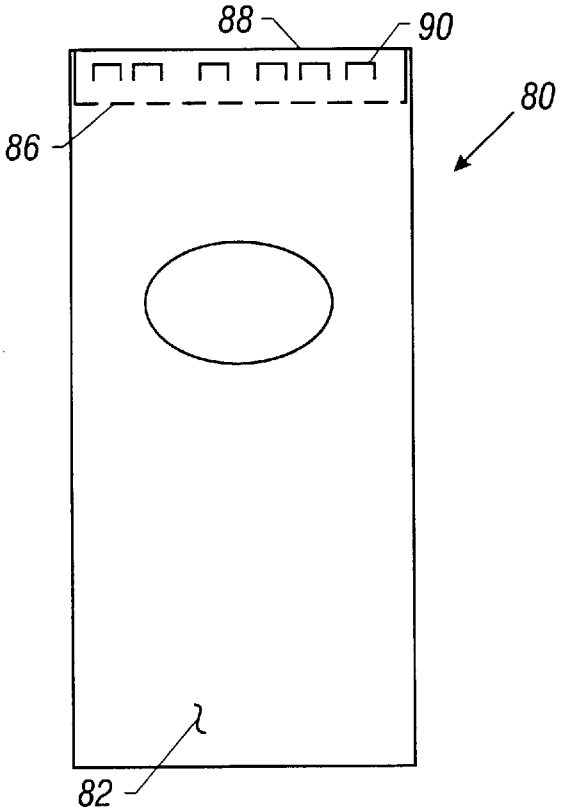
FIG. 11 is a front elevational view of a lottery ticket of a fifth preferred embodiment.
Figure 13:
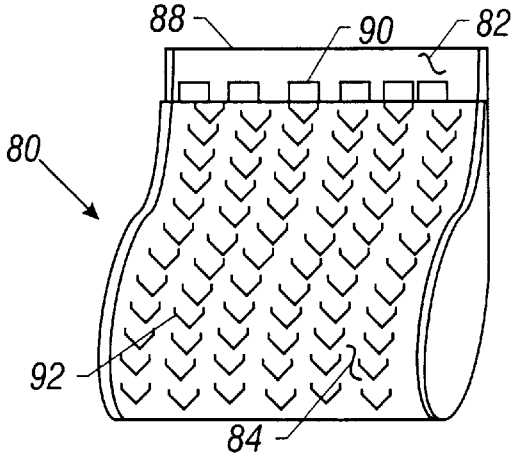
FIG. 13 is a front perspective view of the lottery ticket illustrated in FIGS. 11 and 12 being manipulated for decryption.
Figure 12:
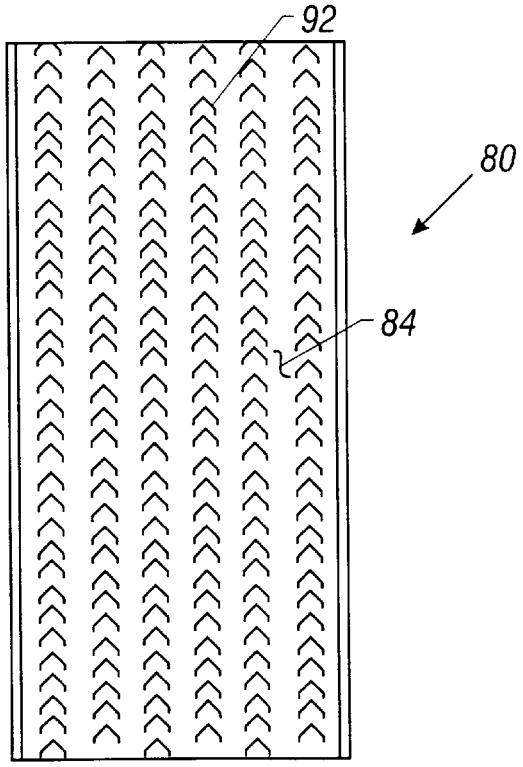
FIG. 12 is a rear elevational view of the lottery ticket illustrated in FIG. 11.

Referring to FIGS. 11–13, there is generally indicated at 80 a lottery ticket of a fifth preferred embodiment. The lottery ticket comprises a front surface 82 (FIG. 11) and a back surface 84 (FIG. 12). As with lottery ticket 60, a first area 86 is provided on the front surface 82 and located adjacent a top edge 88 of the lottery ticket 80. The first area 86 has a first set of gaming indicia 90 disposed thereon that form upper halves or portions of prize symbols. Referring to FIG. 12, the back surface 84 has a second set of gaming indicia 92 disposed thereon that form lower portions of prize symbols. As shown, the upper and lower portions of prize symbols, when in registry, illustrate a home base of a baseball-type game. The second set of gaming indicia 92 include a plurality of lower portions of prize symbols arranged in six columns so that the lottery can be preprinted with the second set of gaming indicia 92 without having to print on both sides of the lottery ticket 80 at the terminal.

The arrangement is such that when folding the ticket in the manner illustrated in FIG. 12 and aligning the second set of gaming indicia 92 below the first set of gaming indicia 90, the winning status of the lottery ticket is determined if the upper portions of prize symbols register with the lower portions of prize symbols to create at least one complete prize symbol. As shown, two pairs of upper and lower portions of prize symbols are in registry to create two complete prize symbols for the lottery ticket illustrated in FIGS. 11–13.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A lottery ticket comprising:

a first edge;

a second opposite edge;

a first area located adjacent the first edge, the first area having a first set of gaming indicia disposed thereon, said first set of gaming indicia forming lower portions of prize symbols; and a second area located adjacent the second edge, the second area having a second set of gaming indicia disposed thereon, said second gaming indicia forming upper portions of prize symbols, wherein upon folding the ticket about a horizontal axis and aligning the second set of gaming indicia above the first set of gaming indicia, the winning status of the lottery ticket is determined if the upper portions of prize symbols register with the lower portions of prize symbols to create at least one complete prize symbol.

2. The lottery ticket set forth in claim 1, each upper portion of prize symbols of the second set of gaming indicia having a form of one portion of baseball home plate symbols and each lower portion of prize symbols of the first set of gaming indicia having a form of a second portion of the baseball home plate symbols.

3. The lottery ticket set forth in claim 1, each upper portion of prize symbols of the second set of gaming indicia having a form of one portion of playing cards and each lower portion of prize symbols of the first set of gaming indicia having a form of a second portion of the playing cards.

4. The lottery ticket set forth in claim 1, each upper portion of prize symbols of the second set of gaming indicia having a form of one portion of numbers and each lower portion of prize symbols of the first set of gaming indicia having a form of a second portion of the numbers.

5. The lottery ticket set forth in claim 1, said first set of gaming indicia having at least two rows of lower portions of prize symbols.

6. The lottery ticket set forth in claim 1 further comprising at least one pair of alignment marks disposed on a surface of the ticket, one alignment mark being disposed a predetermined distance from a side edge adjacent the first edge and the other alignment mark being disposed said predetermined distance from said side edge adjacent the second edge.

7. A method of playing a lottery game with a ticket comprising a first edge, a second opposite edge, a first area located adjacent the first edge, the first area having a first set of gaming indicia disposed thereon, said first set of gaming indicia forming lower portions of prize symbols, and a second area located adjacent the second edge, the second area having a second set of gaming indicia disposed thereon, said second set of gaming indicia forming upper portions of prize symbols, said method comprising the steps of:

folding the ticket about a horizontal axis; and aligning the second set of gaming indicia above the first set of gaming indicia, the lottery ticket being a winning ticket if the upper portions of prize symbols register with lower portions of prize symbols to create at least one complete prize symbol.

8. The method set forth in claim 7, said first set of gaming indicia having at least two rows of lower portions of prize symbols, said step of aligning the second set of gaming indicia above the first set of gaming indicia comprising the step of aligning the second set of gaming indicia with each row of lower portions of prize symbols.

9. A lottery ticket comprising:

a front surface;

a first edge;

a first area on the front surface and located adjacent the first edge, the first area having a first set of gaming indicia disposed thereon, said first set of gaming indicia forming upper portions of prize symbols; and a second area on the front surface, the second area being parallel to the first area and spaced from the first area, the second area having a second set of gaming indicia disposed thereon, said second gaming indicia forming lower portions of prize symbols, wherein upon folding the ticket and aligning the second set of gaming indicia below the first set of gaming indicia, a winning status of the lottery ticket is determined if the upper portions of prize symbols register with the lower portions of prize symbols to create at least one complete prize symbol.

10. A lottery ticket comprising:

a front surface;

a back surface;

a first edge;

a first area on the front surface and located adjacent the first edge, the first area having a first set of gaming indicia disposed thereon, said first set of gaming indicia forming upper portions of prize symbols; and a second set of gaming indicia disposed on the back surface, said second gaming indicia forming lower portions of prize symbols, wherein upon folding the ticket and aligning the second set of gaming indicia below the first set of gaming indicia, a winning status of the lottery ticket is determined if the upper portions of prize symbols register with the lower portions of prize symbols to create at least one complete prize symbol.

* * * * *

UNITED STATES PATENT AND TRADEMARK OFFICE

CERTIFICATE OF CORRECTION

PATENT NO. : 6,000,725
DATED : December 14, 1999
INVENTOR(S) : Roy S. Nicolosi et al.

It is certified that error appears in the above-identified patent and that said Letters Patent is hereby corrected as shown below:

Title page,
Under item [56], "References Cited" add the following U.S. Patent Documents:

| | | | |
|---|---|---|---|
| 1,774,177 | 8/1930 | Harris | 235/74 |
| 5,362,105 | 11/1994 | Scott | 283/903 |

Column 6,
Line 27, replace the second occurrence of "the" with -- a --.

Signed and Sealed this

Ninth Day of October, 2001

*Attest:*

Nicholas P. Godici

*Attesting Officer*

NICHOLAS P. GODICI
*Acting Director of the United States Patent and Trademark Office*